US008420580B2

(12) United States Patent
Iwata et al.

(10) Patent No.: US 8,420,580 B2
(45) **Date of Patent: *Apr. 16, 2013**

(54) SLIDING RESIN COMPOSITION

(75) Inventors: Hideki Iwata, Inuyama (JP); Seiji Amano, Inuyama (JP)

(73) Assignee: Daido Metal Company, Nagoya (JP)

( * ) Notice: Subject to any disclaimer, the term of this patent is extended or adjusted under 35 U.S.C. 154(b) by 58 days.

This patent is subject to a terminal disclaimer.

(21) Appl. No.: 12/973,239

(22) Filed: Dec. 20, 2010

(65) Prior Publication Data

US 2011/0152140 A1 Jun. 23, 2011

(30) Foreign Application Priority Data

Dec. 18, 2009 (JP) ..... 2009-287642

(51) Int. Cl.
*C10M 111/04* (2006.01)
*C10M 169/04* (2006.01)
*C09G 3/00* (2006.01)

(52) U.S. Cl.
USPC ..... 508/129; 508/106; 508/131; 508/154; 508/168; 508/181

(58) Field of Classification Search ..... 508/131, 508/168, 590, 129, 154
See application file for complete search history.

(56) References Cited

U.S. PATENT DOCUMENTS 4,847,135 A * 7/1989 Braus et al. ..... 428/138

FOREIGN PATENT DOCUMENTS

| | | | |
|---|---|---|---|
| JP | 2219849 | A | 9/1990 |
| JP | 9136987 | A | 5/1997 |
| JP | 2004083640 | A | 3/2004 |

* cited by examiner

*Primary Examiner* — Ellen McAvoy
*Assistant Examiner* — Vishal Vasisth
(74) *Attorney, Agent, or Firm* — Browdy and Neimark, PLLC

(57) ABSTRACT

A sliding resin composition is provided which hardly seizes by decreasing oil repellency of PTFE to prevent discharging of lubricating oil from sliding surface. That is, by using resin composition 1 where particles of PTFE 3 in the surface of which inorganic compound 4 having oil-absorptivity is embedded are dispersed in synthetic resin 2, the inorganic compound 4 having oil-absorptivity absorbs and retains lubricating oil, and oil repellency of PTFE 3 on the sliding surface can be decreased. Thus, discharging of the lubricating oil from the sliding surface can be inhibited and resin composition 1 hardly seizes.

7 Claims, 1 Drawing Sheet

SLIDING RESIN COMPOSITION

BACKGROUND OF THE INVENTION

The present invention relates to a sliding resin composition comprising a synthetic resin which contains polytetrafluoroethylene (hereinafter referred to as "PTFE") as a solid lubricant and an inorganic compound having oil-absorptivity.

Hitherto, there have been used sliding resin compositions comprising various synthetic resins which contain PTFE as a solid lubricant. As these sliding resin compositions, proposed are those which comprise various synthetic resins which further contain a phosphate in addition to PTFE. When sliding resin compositions containing PTFE and a phosphate are used, the phosphate promotes transfer adhesion of PTFE to the surface of a counter member during sliding to form a transfer adhesion film of PTFE on the surface of the counter member, resulting in improvement of sliding characteristics of resin sliding member under dry condition.

For example, Japanese Patent No. 2777724 (Patent Document 1) discloses use of calcium phosphate, magnesium phosphate, barium phosphate, or lithium phosphate as an inorganic compound having function to form a transfer adhesion film of PTFE. However, recently, as the inorganic compounds, there are also known inorganic compounds such as lithium tertiary phosphate, calcium tertiary phosphate, calcium hydrogenphosphate or anhydride thereof, magnesium hydrogenphosphate or anhydride thereof, lithium pyrophosphate, calcium pyrophosphate, magnesium pyrophosphate, lithium metaphosphate, calcium metaphosphate, magnesium metaphosphate, lithium carbonate, magnesium carbonate, calcium carbonate, strontium carbonate, barium carbonate, calcium sulfate, and barium sulfate.

Furthermore, JP-A-9-136987 (Patent Document 2) and JP-A-2004-83640 (Patent Document 3) disclose to impart functions such as absorption and retention of liquids (e.g., lubricating oil) to the sliding resin compositions by using calcium carbonate having porous structure.

Patent Document 1: Japanese Patent No. 2777724
Patent Document 2: JP-A-9-136987
Patent Document 3: JP-A-2004-83640

SUMMARY OF THE INVENTION

However, even when a resin composition comprising a synthetic resin in which PTFE and an inorganic compound are uniformly dispersed as in Patent Document 1 is used, under such conditions as lubricating oil being insufficient, for example, at starting of apparatuses, PTFE does not dissolve in the synthetic resin and is dispersed in the form of particles at the sliding surface and besides PTFE has oil repellency. Therefore, the lubricating oil repelled at the surface of particles of PTFE in the resin composition is apt to be discharged from the sliding surface and the resin composition sometimes seizes. Furthermore, even when a resin composition in which porous bodies which absorb lubricating oil is used as in Patent Documents 2 and 3, the resin composition sometimes seizes since the inorganic compound per se is inferior in sliding characteristics. The present invention has been accomplished under the above circumstances, and the object is to provide a sliding resin composition which hardly seizes under such conditions as lubricating oil being insufficiently present by decreasing oil repellency of PTFE and inhibiting discharging of lubricating oil from the sliding surface.

That is, in order to attain the above object, the present invention includes the following constituents.

(1) A sliding resin composition comprising a synthetic resin containing PTFE, as a solid lubricant and an inorganic compound having oil-absorptivity wherein the PTFE is dispersed in the form of particles in the synthetic resin, and the inorganic compound having oil-absorptivity is embedded in the surface of particles of the PTFE.

(2) A sliding resin composition of (1) wherein the area ratio of the inorganic compound having oil-absorptivity on the surface of particles of the PTFE is in the range of 5-30%.

(3) A sliding resin composition of (1) or (2) wherein the average particle diameter of the inorganic compound having oil-absorptivity is not more than ⅓ of the average particle diameter of the PTFE.

(4) A sliding resin composition of (1), (2) or (3) wherein the synthetic resin additionally contains one or more of molybdenum disulfide, tungsten disulfide and graphite as the solid lubricant.

Figure 1:
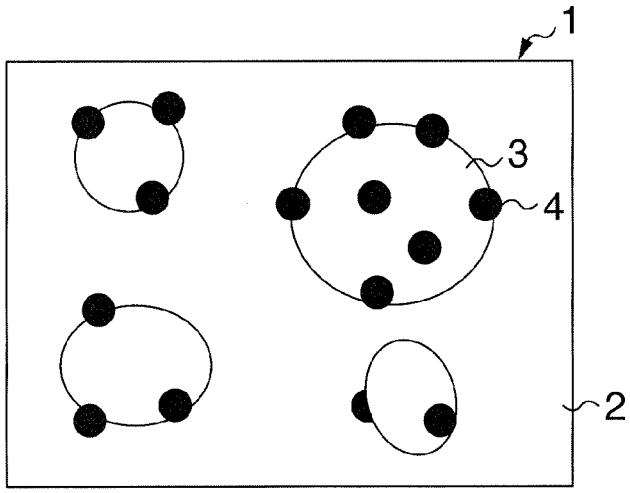
FIG. 1 is a schematic view showing the resin composition where the inorganic compound having oil-absorptivity is embedded in the surface of particles of the PTFE.

In the above drawings, reference numeral 1 indicates resin composition, 2 indicates synthetic resin, 3 indicates PTFE, and 4 indicates inorganic compound.

DESCRIPTION OF EMBODIMENTS

In order to attain the above object, the sliding resin composition of the above (1) is characterized in that it comprises a synthetic resin containing PTFE as a solid lubricant and an inorganic compound having oil-absorptivity wherein the PTFE is dispersed in the form of particles in the synthetic resin, and the inorganic compound having oil-absorptivity is embedded in the surface of particles of the PTFE.

The state of the inorganic compound having oil-absorptivity (absorptivity for lubricating oil) being embedded in the surface of particles of PTFE in the present invention is not limited to such a state that the whole of the particle of the inorganic compound having oil-absorptivity is completely embedded in the surface of particles of PTFE, but includes such a state that only a part of the particle of the inorganic compound having oil-absorptivity is embedded in the surface of the particle of PTFE, namely, such a state that the particle of the inorganic compound having oil-absorptivity attaches to the surface of the particle of PTFE.

As the synthetic resins in the present invention, there may be used general synthetic resins such as polyimide, polyamidimide, polybenzimidazole, polyethylene, polypropylene, polyether ether ketone, polyphenylene sulfide, polyamide, polyacetal, etc. The kind of the synthetic resins has no direct relation with the effect to decrease the oil repellency of PTFE and hence optional synthetic resins can be used. However, particularly such synthetic resins as polyimide, polyamidimide and polybenzimidazole are high in heat resistance and strength, and these are suitable for sliding resin compositions used under high load conditions. Content of the PTFE in the sliding resin composition is preferably 30-50 mass %, and that of the inorganic compound having oil-absorptivity in the sliding resin composition is preferably 5-20 mass %, and the contents can be adjusted depending on the sliding conditions and the kind of the inorganic compound.

As the PTFE in the present invention, there may be suitably used molding powders obtained by suspension polymerization. When molding powders obtained by suspension polymerization are used, the particles of the inorganic compound having oil-absorptivity can be embedded by pressing them onto the surface of particles of PTFE by external force (mechanical force), and further the particles of PTFE are not deformed (to flaky form) by external force and the aspect ratio (length of longer diameter of PTFE particle/length of shorter diameter of PTFE particle) of PTFE in which the inorganic compound having oil-absorptivity is embedded can be less than 1.5. Therefore, particles of PTFE can be easily dispersed in the synthetic resin.

As the inorganic compounds having oil-absorptivity in the present invention, there may be used those which have porous structure and have an oil absorption of 150 ml/100 g or more and comprise, as components, at least one of inorganic compounds such as calcium phosphate, barium phosphate, magnesium phosphate, lithium phosphate, lithium tertiary phosphate, calcium tertiary phosphate, calcium hydrogenphosphate or anhydride thereof, magnesium hydrogenphosphate or anhydride thereof, lithium pyrophosphate, calcium pyrophosphate, magnesium pyrophosphate, lithium metaphosphate, calcium metaphosphate, magnesium metaphosphate, lithium carbonate, magnesium carbonate, calcium carbonate, strontium carbonate, barium carbonate, calcium sulfate, and barium sulfate, and there may also be used composites of these components. The inorganic compounds having oil-absorptivity are more preferably those which have a petaloid porous structure. The inorganic compounds having a petaloid porous structure are commercially available, and the petaloid porous structure is disclosed also in Patent Document 3, and hence detailed explanation thereon is omitted here. When the inorganic compounds have the petaloid porous structure, specific surface area of the inorganic compounds can be increased and oil-absorptivity of the inorganic compounds can be enhanced.

Furthermore, the sliding resin composition of the present invention may be used for sliding members in which it is coated in the form of layers on the surface of a substrates of various metals, or sliding members in which a porous metal sintered layer is formed on the substrates of various metals and is impregnated and coated with the sliding resin composition.

The sliding resin composition of the above (2) is characterized in that the area ratio of the inorganic compound having oil-absorptivity on the surface of particles of PTFE is in the range of 5-30% in the sliding resin composition of the above (1).

The sliding resin composition of the above (3) is characterized in that the average particle diameter of the inorganic compounds having oil-absorptivity is not more than ⅓ of the average particle diameter of PTFE in the sliding resin composition of the above (1) or (2).

The sliding resin composition of the above (4) is characterized in that the synthetic resin in the sliding resin composition of the above (1), (2) or (3) additionally contains one or more of molybdenum disulfide, tungsten disulfide and graphite as the solid lubricant.

In the sliding resin composition of the above (1), PTFE is added to the synthetic resin for the purpose of improving frictional wear characteristics of the synthetic resin or forming a transfer adhesion film of PTFE on the surface of the associated shaft. However, under such conditions as sliding speed being high and lubricating oil being insufficiently present, since PTFE in the resin composition has oil repellency, the lubricating oil repelled at the surface of particles of PTFE is apt to be discharged from the sliding surface due to rotating force of the associated shaft, and as a result, the resin composition sometimes seizes. On the other hand, in the resin composition of the present invention, since the inorganic compound having oil-absorptivity is in the state of being embedded in the surface of particles of PTFE, the inorganic compound having oil-absorptivity absorbs and retains the lubricating oil also on the surface of particles of PTFE and thus oil repellency of the PTFE at the sliding surface can be decreased. Therefore, the lubricating oil can be inhibited from being discharged from the sliding surface, and seizing of the resin composition is hardly caused.

On the other hand, when an inorganic compound having porous structure is used as in Patent Documents 2 and 3 in the resin composition in which particles of PTFE and an inorganic compound are uniformly dispersed in a binder resin comprising a synthetic resin as in Patent Document 1, oil repellency of particles of PTFE at the sliding surface does not decrease, and the lubricating oil repelled at the surface of particles of PTFE is easily discharged from the sliding surface due to rotating force of associated shaft, which readily causes seizing.

As in the invention of the above (2), it is preferred that the area ratio of the inorganic compound having oil-absorptivity on the surface of particles of PTFE is in the range of 5-30%. If the area ratio of the inorganic compound having oil-absorptivity is less than 5%, the amount of the inorganic compound is too small, and hence the effect to decrease the oil repellency of PTFE cannot be sufficiently obtained. On the other hand, if the area ratio of the inorganic compound having oil-absorptivity exceeds 30%, the amount of PTFE on the surface of particles is too small, and the sliding characteristics of PTFE is damaged.

Furthermore, in the case of the sliding resin composition of the present invention, the particles of the inorganic compound having oil-absorptivity are previously embedded by pressing them onto the surface of the particles of PTFE by external force (mechanical force), and as mentioned in the above (3), it is preferred that the average particle diameter of the inorganic compound is not more than ⅓ of the average particle diameter of the PTFE. The smaller the particle diameter of the inorganic compound than the particle diameter of PTFE, the easier the attainment of the embedding of the inorganic compound in the surface of particles of PTFE. On the other hand, if the ratio of the particle diameter exceeds ⅓, the inorganic compound is present unevenly and one-sidedly on the surface of particles of PTFE.

Furthermore, as mentioned in the above (4), sliding characteristics of the resin sliding member can be enhanced by additionally adding one or more of molybdenum disulfide, tungsten disulfide and graphite to the synthetic resin as the solid lubricant. Content of these solid lubricants may be adjusted depending on the sliding conditions under which the resin sliding member is used, and specifically, 1-60 mass % of the solid lubricant may be contained in the sliding resin composition.

Referring to FIG. 1, explanation will be made on resin composition 1 of an embodiment of the present invention in which polyamidimide (hereinafter referred to as "PAI") is used as synthetic resin 2 and a composite of calcium carbonate and calcium phosphate having a petaloid porous structure ("PORONEX" (trademark)) manufactured by Maruo Calcium Co., Ltd. (hereinafter referred to as "$CaCO_3$ petaloid porous body) is used as inorganic compound 4 which is embedded in the surface of particles of PTFE 3. The PTFE 3 is a molding powder produced by suspension polymerization, and there may be used "TEFLON 7A-J (trademark)" and "TEFLON MP-1300 (trademark)" manufactured by Mitsui Du Pont Co., Ltd., "FLUON G 190 (trademark)" manufactured by Asahi Glass Co., Ltd., and the like. Further, as shown in FIG. 1, $CaCO_3$ petaloid porous body which is inorganic compound 4 is embedded in the surface of particles of PTFE 3, and the PTFE 3 is dispersed in the synthetic resin 2. In FIG. 1, a section of the rein composition 1 is shown, and the same texture as of the section of the resin composition 1 appears also on the sliding surface in the resin sliding member.

In this embodiment, the $CaCO_3$ petaloid porous body which is the inorganic compound 4 having an average particle diameter of 5 μm is previously embedded in the surface of particles of PTFE 3 ("TEFLON 7A-J (trademark)" manufactured by Mitsui Du Pont Co., Ltd.) having an average particle diameter of 30 μm by using a general roll mill kneading machine. Specifically, when particles of PTFE 3 and inorganic compound 4 pass between two rolls differing in revolving direction, particles of the inorganic compound 4 are pressed onto the surface of particles of PTFE 3 by an external force (pressing force between the rolls and shearing force between roll surfaces) to embed the particles of the inorganic compound 4.

The inventors have confirmed that particles of various inorganic compounds 4 can be embedded in the surface of the particles of PTFE 3 and furthermore particles of PTFE 3 can be prevented from becoming flaky only by combination of using a molding powder produced by suspension polymerization as PTFE 3 and employing a mixing and kneading method of such a type as passing the sample between revolving rolls such as of a roll mill kneading machine. The particles of PTFE 3 having the inorganic compound 4 embedded in the surface which are obtained by the above combination of using the molding powder and employing the mixing and kneading method have an aspect ratio of less than 1.5, and can be uniformly dispersed in the synthetic resin 2.

On the other hand, when a molding powder prepared by suspension polymerization ("TEFLON 7A-J (trademark)" manufactured by Mitsui Du Pont Co., Ltd. having an average particle diameter of 30 μm) is used as the PTFE and a method of mixer type using a revolving agitation blade or a method of jet mill type of impinging sample powders against each other at a high speed is employed as an other general mixing and kneading method, the inorganic compound cannot be embedded in the surface of particles of PTFE. Furthermore, in the case of employing a mixing and kneading method of ball mill type in combination with use of the molding powder, the inorganic compound can be embedded in the surface of the particles of PTFE, but the particles of PTFE bind with each other to cause coarse granulation, and it is difficult to disperse them in the synthetic resin at a later step.

Furthermore, when a fine powder prepared by emulsion polymerization ("MP1500-J (trademark)" manufactured by Mitsui Du Pont Co., Ltd. having an average particle diameter of 20 μm) is used as PTFE, and a mixing and kneading method of such a type as passing the sample between revolving rolls such as roll mill kneading machine is employed, the surface of particles of PTFE is soft, and the inorganic compound can be easily embedded, but PTFE is apt to become fibrous by the external force of mixing and kneading, resulting in formation of flaky particles of PTFE. In the case of resin composition in which flaky particles of PTFE are dispersed in the synthetic resin, when a sliding member is made by coating the resin composition on a metallic substrate, the flaky particles of PTFE are arranged in parallel to the coating surface (sliding surface), and thus strength of the sliding member is conspicuously deteriorated. Moreover, when a porous metal sintered layer is formed on the surface of the metallic substrate, and the porous metal sintered layer is impregnated with the resin composition, the flaky particles of PTFE can hardly penetrate into the porous metal sintered layer, and it becomes difficult to impregnate and coat the resin composition.

Moreover, when a heat-treated and baked PTFE ("KT-400M (trademark) manufactured by Kitamura Co., Ltd. having an average particle diameter of 33 μm) is used as the particles of PTFE, the surface of particles of PTFE is hard, and the inorganic compound can hardly be embedded.

As mentioned above, a resin sliding member can be obtained by diluting particles of PTFE 3 in which the inorganic compound 4 is previously embedded and PAI with an organic solvent, coating the resulting resin composition 1 in the state of coating composition on the surface of a metallic substrate, then heating the solvent for drying and heating the resin composition 1 for baking. In this embodiment, there is shown a method of previously embedding the inorganic compound 4 in the surface of particles of PTFE 3, but the present invention is not limited to this method. For example, embedding of the inorganic compound 4 in the surface of particles of PTFE 3 and mixing of synthetic resin 2 with the particles of PTFE 3 may be simultaneously carried out by processing with a roll mixing and kneading machine the coating composition prepared by diluting the synthetic resin 2, the PTFE 3 and the inorganic compound 4 with an organic solvent.

It is preferred that the area ratio of the inorganic compound 4 on the surface of particles of PTFE 3 in which the inorganic compound 4 is embedded is in the range of not less than 5% and not more than 30%. If the area ratio of the inorganic compound 4 is less than 5%, the amount of inorganic compound 4 is too small, and hence the effect to decrease the oil repellency of PTFE 3 cannot be sufficiently obtained. On the other hand, if the area ratio of inorganic compound 4 exceeds 30%, the amount of PTFE 3 on the surface of particles is too small, and hence the sliding characteristics of PTFE 3 are damaged.

In the sliding resin composition 1, the whole of the inorganic compound 4 contained is not needed to be embedded in the surface of PTFE 3, and a part of the inorganic compound 4 may be independently dispersed in the synthetic resin 2. Moreover, in the sliding resin composition 1, it is most preferred that the inorganic compound 4 is embedded in the surface of all the particles of PTFE 3, and this state can be obtained by prolonging the time for mixing and kneading the particles of PTFE 3 and the inorganic compound 4, but this results in deterioration of productivity. When the productivity is to be enhanced by shortening the time for mixing and kneading of the particles of PTFE 3 and the inorganic compound 4, the inorganic compound 4 may not be embedded in the surface of a part of the particles of PTFE 3. Specifically, the inventors have confirmed that if the inorganic compound 4 is embedded in the particles of at least 50% of PTFE 3 contained in the resin composition 1, the oil repellency of PTFE 3 can be decreased.

It is preferred that the average particle diameter of the inorganic compound 4 is not more than ⅓ of the average particle diameter of PTFE 3. The smaller the particle diameter of the inorganic compound 4 than the particle diameter of PTFE 3, the easier the attainment of the embedding of the inorganic compound 4 in the surface of particles of PTFE 3. On the other hand, if the ratio of the particle diameter exceeds ⅓, the inorganic compound 4 is unevenly and one-sidedly present on the surface of particles of PTFE 3.

As the synthetic resin 2, general synthetic resins such as polyimide, polyamidimide, polybenzimidazole, polyethylene, polypropylene, polyether ether ketone, polyphenylene sulfide, polyamide, polyacetal, etc. can be used. The kind of synthetic resin 2 has no direct relation with the effect to decrease the oil repellency of PTFE 3, and hence optional synthetic resins 2 can be used. Particularly, synthetic resins 2 such as polyimide, polyamidimide and polybenzimidazole are high in heat resistance and strength, and these are suitable for sliding resin composition 1 in such circumstances as lubricating oil being insufficiently present on the sliding surface at the starting of apparatus. Content of PTFE 3 in the resin composition 1 is desirably 30-50 mass %, and that of the inorganic compound 4 in the sliding resin composition 1 is desirably 5-20 mass %, and the contents can be adjusted depending on the sliding conditions and the kind of the inorganic compound 4.

The inorganic compound 4 is not limited to $CaCO_3$ petaloid porous body shown in this embodiment, and there may be used those which have porous structure and have an oil absorption of 150 ml/100 g or more and comprise, as component, at least one of inorganic compounds such as barium phosphate, magnesium phosphate, calcium phosphate, lithium phosphate, lithium tertiary phosphate, calcium tertiary phosphate, calcium hydrogenphosphate or anhydride thereof, magnesium hydrogenphosphate or anhydride thereof; lithium pyrophosphate, calcium pyrophosphate, magnesium pyrophosphate, lithium metaphosphate, calcium metaphosphate, magnesium metaphosphate, lithium carbonate, magnesium carbonate, strontium carbonate, barium carbonate, calcium sulfate, and barium sulfate, and there may also be used composites of them. These inorganic compounds 4 are more preferably those which have a petaloid porous structure.

Furthermore, the resin composition 1 may additionally contain one or more of molybdenum disulfide, tungsten disulfide and graphite as the solid lubricant. The sliding characteristics of the resin composition 1 can be enhanced by dispersing the particles of these solid lubricants in synthetic resin 2. The content of the solid lubricant may be adjusted depending on the sliding conditions under which the resin composition 1 is used, and specifically, it may be contained in an amount of 1-60 mass % in the resin composition 1.

Next, ring-on-disk sliding tests were conducted in Examples 1-5 and Comparative Examples 1-4 using the resin composition 1 of this embodiment. The compositions of resin composition 1 in Comparative Examples 1-4 and Examples 1-5 are shown in Table 1. In Examples and Comparative Examples, PAI was used as all of the synthetic resin 2, and a molding powder having an average particle diameter of 30 μm prepared by suspension polymerization was used as PTFE 3. Heavy calcium carbonate having no oil-absorptivity (less in oil absorption, namely, 28 ml/100 g and having no sufficient oil-absorptivity) "SUPER SSS (trademark)" manufactured by Maruo Calcium Co., Ltd. (hereinafter referred to as "$CaCO_3$") was used as the inorganic compound 4 in Comparative Example 1. $CaCO_3$ petaloid porous body ("PORONEX" (trademark) manufactured by Maruo Calcium Co., Ltd.) having oil-absorptivity (oil absorption: 150 ml/100 g) as the inorganic compound 4 in Comparative Examples 2-4 and Examples 1-5. Further, molybdenum disulfide was used as the solid lubricant in Example 2.

TABLE 1

| | Components (mass %) | Whether inorganic compound had oil-absorptivity or not | Whether inorganic compound was embedded or not | Time until seizing occurred |
|---|---|---|---|---|
| Comparative Example 1 | PAI + 30% PTFE + 15% $CaCO_3$ | No | Embedded | 5 min |
| Comparative Example 2 | PAI + 30% PTFE + 5% $CaCO_3$ petaloid porous body | Yes | Not embedded | 6 min |
| Comparative Example 3 | PAI + 30% PTFE + 15% $CaCO_3$ petaloid porous body | Yes | Not embedded | 7 min |
| Comparative Example 4 | PAI + 30% PTFE + 20% $CaCO_3$ petaloid porous body | Yes | Not embedded | 4 min |
| Example 1 | PAI + 30% PTFE + 15% $CaCO_3$ petaloid porous body | Yes | Embedded | 18 min |
| Example 2 | PAI + 30% PTFE + 15% $CaCO_3$ petaloid porous body + 5% molybdenum disulfide | Yes | Embedded | 20 min |
| Example 3 | PAI + 50% PTFE + 5% $CaCO_3$ petaloid porous body | Yes | Embedded | 12 min |
| Example 4 | PAI + 50% PTFE + 10% $CaCO_3$ petaloid porous body | Yes | Embedded | 25 min |
| Example 5 | PAI + 30% PTFE + 20% $CaCO_3$ petaloid porous body | Yes | Embedded | 11 min |

In Comparative Example 1 and Examples 1-5, particles of $CaCO_3$ or $CaCO_3$ petaloid porous body were previously embedded in the surface of all particles of PTFE 3 by a roll kneading machine in such a manner that the area ratio of the inorganic compound 4 on the surface of particles of PTFE 3 was 25%. The area ratio of $CaCO_3$ or $CaCO_3$ petaloid porous body which was inorganic compound 4 on the surface of particles of PTFE 3 can be measured in the following manner. That is, a compositional image of the composition at 2000× magnification was photographed by an EPMA apparatus and the ratio of areas of PTFE 3 and the inorganic compound 4 was calculated by processing the photographed image using a general image analyzing system.

Furthermore, in Comparative Example 1 and Examples 1-5, the resin composition 1 having the composition as shown in Table 1 in which particles of $CaCO_3$ or $CaCO_3$ petaloid porous body were previously embedded in the surface of particles of PTFE 3 was diluted with an organic solvent and mixed by a general agitation mixing machine (mixer type) to prepare a coating composition. This was coated on the surface of a metallic substrate, followed by subjecting the organic solvent to heating for drying and the resin composition 1 to heating for baking. A metallic substrate comprising a steel backing metal layer and a porous metal layer which was previously and separately prepared was used as the metallic substrate, and the porous metal layer was impregnated and coated with the resin composition 1 to prepare a sample for ring-on-disk sliding test.

In Comparative Examples 2-4, there were used the same synthetic resin 2, PTFE 3 and inorganic compound 4 as those in Examples 1-5. The Comparative Examples 2-4 were different from Example 1 in that the $CaCO_3$ petaloid porous body which was the inorganic compound 4 was not embedded in the surface of particles of PTFE 3. That is, in Comparative Examples 2-4, without previously embedding particles of the $CaCO_3$ petaloid porous body in the surface of particles of PTFE 3, the resin composition 1 having the composition as shown in Table 1 was diluted with an organic solvent and made into the state of coating composition by mixing with a general agitation mixing machine (mixer type). The form of the sample for sliding test and method for making the sample were the same as in Comparative Example 1 and Examples 1-5.

The conditions of the ring-on-disk sliding test are shown in Table 2. When after starting of the sliding test and carrying out break-in operation, the lubricating oil was forcedly drawn from oil bath, the coefficient of friction was the same as in the break-in operation while the lubricating oil was retained on the sliding surface, but when the lubricating oil was discharged from the sliding surface, the coefficient of friction abruptly increased to generate frictional heat, and as a result, the resin composition 1 seized. Therefore, the sliding test was evaluated in terms of the time from the forced drawing of lubricating oil from oil bath until seizing of the resin composition 1. The results are shown in Table 1. Whether the resin composition 1 seized or not was judged by the time when the back side of the sliding surface of sample reached 190° C.

TABLE 2

| Items | Conditions | Unit |
|---|---|---|
| Surface pressure | 5 | MPa |
| Sliding speed | 2 | m/s |
| Lubricating oil | Gas oil | — |
| Roughness of test shaft | 0.2 | Ra |
| Kind of test shaft | S55C hardened | — |
| Hardness of test shaft | 500-600 | Hv |
| Roughness of sliding surface | 0.2 | Ra |

In Comparative Example 1 and Example 1, it was confirmed that the time until resin composition 1 seized was different differed due to the difference in oil-absorptivity of inorganic compound 4. In Comparative Example 1 and Example 1, resin composition 1 had the same compositional ratio, and particles of PTFE 3 having inorganic compound 4 embedded in the surface were in the same state of being dispersed in PAI (synthetic resin 2). The time until resin composition 1 seized was 5 minutes in Comparative Example 1 while it was 18 minutes in Example 1. It is considered that this is because in Comparative Example 1, when lubricating oil was forcedly drawn from the oil bath, $CaCO_3$ having no oil-absorptivity was too small in the effect to absorb and retain the lubricating oil and hence oil repellency of PTFE 3 could not be decreased, and thus the lubricating oil was discharged from the sliding surface, resulting in seizing of resin composition 1 in a short time. On the other hand, in Example 1 where $CaCO_3$ petaloid porous body having oil-absorptivity was contained, the $CaCO_3$ petaloid porous body on the surface of particles of PTFE 3 retained sufficiently the lubricating oil, whereby the oil repellency of PTFE 3 was decreased. Therefore, the lubricating oil was hardly discharged from the sliding surface, and as a result, the time until resin composition 1 seized was longer than in Comparative Example 1.

In Comparative Examples 2-4 and Example 1, it was confirmed that there were differences due to whether inorganic compound 4 was embedded or not in the surface of particles of PTFE 3. The time until resin composition 1 seized was 4-7 minutes in Comparative Examples 2-4 while it was 18 minutes in Example 1. This is because as shown in FIG. 1, resin composition 1 of Example 1 was in such a state that the particles of PTFE 3 having $CaCO_3$ petaloid porous body (inorganic compound 4) embedded in the surface were dispersed in PAI (synthetic resin 2), and the $CaCO_3$ petaloid porous body on the surface of particles of PTFE 3 sufficiently retained the lubricating oil to decrease the oil repellency of PTFE 3. It is considered that therefore the lubricating oil was hardly discharged from the sliding surface and the time until resin composition 1 seized was longer than that in Comparative Examples 2-4.

Figure 2:
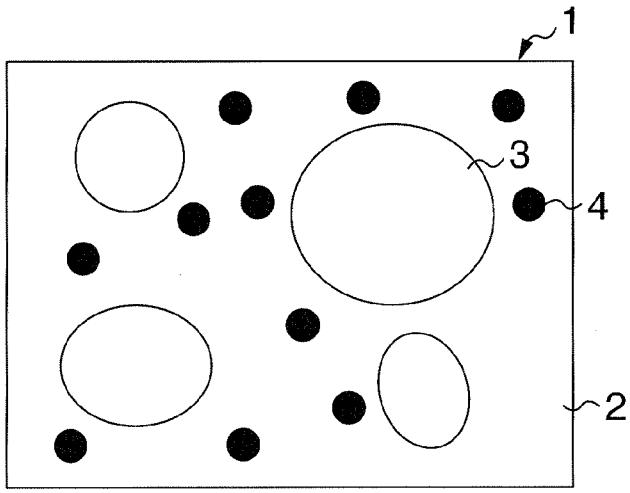
FIG. 2 is a schematic view showing the resin composition where the inorganic compound having oil-absorptivity is not embedded in the surface of particles of the PTFE.

On the other hand, the resin composition 1 of Comparative Examples 2-4 was in such a state that particles of PTFE 3 and $CaCO_3$ petaloid porous body (inorganic compound 4) were independently dispersed in polyamidimide (synthetic resin 2) as shown in FIG. 2, and the oil repellency of PTFE 3 was not decreased. It is considered that therefore the lubricating oil was in the state of being readily discharged from the sliding surface and resin composition 1 seized in a short time.

The resin composition 1 of Example 2 contained additionally molybdenum disulfide as a solid lubricant in the composition of Example 1. Even when the solid lubricant was contained, the $CaCO_3$ petaloid porous body on the surface of particles of PTFE 3 retained the lubricating oil as in Example 1 and an effect to decrease the oil repellency of PTFE 3 was obtained, and besides since the solid lubricant improved the frictional characteristics of synthetic resin 2, and it is considered that thus the time until resin composition 1 seized was longer than that in Example 1.

In the case of resin compositions 1 of Examples 3-5, the compositional ratio in Example 1, namely, contents of PTFE 3 and inorganic compound 4 in PAI (synthetic resin 2) were changed. Thus, if the composition of resin composition 1 was the same as in Example 1, even when the content of PTFE 3 in resin composition 1 was 30-50 mass % and the content of inorganic compound 4 was 5-20 mass %, the $CaCO_3$ petaloid porous body retained the lubricating oil on the surface of particles of PTFE 3 to give the effect to decrease oil repellency of PTFE 3, and it is considered that for this reason, the time until resin composition 1 seized was longer than that in Comparative Examples 2-4 where inorganic compound 4 was not embedded in the surface of particles of PTFE 3.

In these embodiments, the effects were shown by evaluation of sliding tests using resin composition 1 having the composition as shown in Table 1 as an example, but the composition of resin composition 1 of the present invention is not limited to that of Table 1. That is, the composition of resin composition 1 can be optionally adjusted depending on circumstances of using the sliding part of resin composition member and sliding conditions of sliding members. The inventors have confirmed that if the composition of resin composition 1 is the same, when the content of particles of PTFE 3 is 30-50 mass % and that of inorganic compound 4 is 5-20 mass % in the resin composition 1, and when inorganic compound 4 is embedded in the surface of particles of PTFE 3, the time until resin composition 1 seizes is longer than when inorganic compound 4 is not embedded. Furthermore, the inventors have confirmed that the synthetic resin 2 constituting the resin composition 1 is not limited to PAI used in this embodiment, and the effect of the present invention can also be obtained when other kind of synthetic resin 2 is used.

The resin composition according to this embodiment can be used for sliding members for lubrication apparatuses in various industries under the conditions where viscosity of lubricating oil is low or in the circumstances where lubricating oil is diluted. For example, it can be used for sliding members of fuel injection apparatuses which are lubricated with gas oil, compressors where lubricating oil is diluted with refrigerants of hydrofluorocarbon type, hydrofluoroolefin type containing no chlorine or natural refrigerants, and the like. Moreover, it can be used for sliding members for lubrication apparatuses in various industries under the conditions where lubricating oil or grease are squeezed out of the sliding surface at the application of high load or in the circumstances in which the amount of lubricating oil supplied to the sliding surface at starting or stopping of apparatuses is insufficient. For example, it can be used for sliding members of rack and pinion steering apparatuses used under high surface pressure and sliding members of gear pumps where delay of oiling occurs in view of mechanism.

The invention claimed is:

1. A sliding resin composition comprising (1) a synthetic resin containing (2) polytetrafluoroethylene (PTFE) as a solid lubricant in an amount of 30-50% by mass and (3) an inorganic compound having oil-absorptivity in an amount of 5-20% by mass, wherein the polytetrafluoroethylene (2) is dispersed in the form of particles in the synthetic resin (1), the inorganic compound (3) having oil-absorptivity is embedded in the surface of particles of the polytetrafluoroethylene (2), the area ratio of the inorganic compound having oil absorptivity on the surface of particles of the polytetrafluoroethylene is in the range of 5-30%, and the inorganic compound having oil absorptivity is porous.

2. A sliding resin composition according to claim 1, wherein the average particle diameter of the inorganic compound having oil-absorptivity is not more than ⅓ of the average particle diameter of the polytetrafluoroethylene.

3. A sliding resin composition according to claim 1, wherein the synthetic resin additionally contains one or more of molybdenum disulfide, tungsten disulfide and graphite as the solid lubricant.

4. A sliding resin composition according to claim 2, wherein the synthetic resin additionally contains one or more of molybdenum disulfide, tungsten disulfide and graphite as the solid lubricant.

5. A sliding resin composition according to claim 1, wherein the inorganic compound has an oil absorption of 150 ml/100 g.

6. A sliding resin composition according to claim 1, wherein the inorganic compound is at least one selected from the group consisting of barium phosphate, magnesium phosphate, calcium phosphate, lithium phosphate, lithium tertiary phosphate, calcium tertiary phosphate, calcium hydrogenphosphate or anhydride thereof, magnesium hydrogenphosphate or anhydride thereof, lithium pyrophosphate, calcium pyrophosphate, magnesium pyrophosphate, lithium metaphosphate, calcium metaphosphate, magnesium metaphosphate, lithium carbonate, magnesium carbonate, strontium carbonate, barium carbonate, calcium sulfate and barium sulfate.

7. A sliding resin composition according to claim 1, wherein the synthetic resin is at least one member selected from the group consisting of polyimide, polyamidimide, polybenzimidazole, polyethylene, polypropylene, polyether ether ketone, polyphenylene sulfide, polyamide, and polyacetal.

* * * * *